United States Patent [19]

Naef et al.

[11] Patent Number: 4,850,526

[45] Date of Patent: Jul. 25, 1989

[54] PACKAGE FOR A FLAT, ANGULAR PRODUCT AND METHOD OF MAKING THE PACKAGE

[75] Inventors: Ulrich Naef, Neuhausen am Rheinfall; Bruno Mendler, Feuerthalen, both of Switzerland

[73] Assignee: S I G Schweizerische Industrie-Gesellschaft, Neuhausen am Rheinfall, Switzerland

[21] Appl. No.: 191,034

[22] Filed: May 6, 1988

[30] Foreign Application Priority Data

May 8, 1987 [CH] Switzerland ..... 1755/87

[51] Int. Cl.[4] ..... B65D 65/12; B65D 75/08

[52] U.S. Cl. ..... 229/87 R; 53/450; 53/550

[58] Field of Search ..... 229/87 F, 87 R; 53/450, 53/451, 550

[56] References Cited

U.S. PATENT DOCUMENTS

| | | | |
|---|---|---|---|
| 894,559 | 7/1908 | Whyman | 229/87 F |
| 1,262,299 | 4/1918 | Beling | 229/87 R |
| 1,381,425 | 6/1921 | Oldham | 229/87 R |
| 1,640,052 | 8/1927 | Olsen | 229/87 R |
| 1,946,569 | 2/1934 | Clark | 229/87 R |
| 2,001,761 | 5/1935 | Bear | 229/87 B |
| 3,124,298 | 3/1964 | Repko . | |
| 3,505,779 | 4/1970 | Kopp | 53/550 |
| 3,581,979 | 6/1971 | Fuchs | 229/87 R |
| 3,958,390 | 5/1976 | Pringle, Jr. et al. | 53/450 |
| 4,723,701 | 2/1988 | Deutschlander | 229/87 F |
| 4,724,997 | 2/1988 | Hogenkamp et al. | 229/87 F |

FOREIGN PATENT DOCUMENTS

| | | | |
|---|---|---|---|
| 22642 | of 1929 | Australia | 229/87 F |
| 1030247 | 10/1958 | Fed. Rep. of Germany . | |
| 645146 | 10/1928 | France | 229/87 F |
| 851272 | 1/1940 | France | 229/87 F |
| 852801 | 3/1940 | France | 229/87 R |
| 952198 | 11/1949 | France | 229/87 F |
| 7707222 | 1/1979 | Netherlands | 53/550 |
| 254978 | 1/1949 | Switzerland . | |
| 655475 | 12/1978 | Switzerland . | |

*Primary Examiner*—Stephen P. Garbe
*Attorney, Agent, or Firm*—Spencer & Frank

[57] ABSTRACT

A package for a flat, generally rectangular item includes a first, inner wrapper folded about the two large faces and the two side faces and having a longitudinal sealing seam extending on one of the large faces generally parallel to the side faces, and opposite transverse sealing seams at opposite end faces extending parallel thereto. The longitudinal sealing seam and the transverse sealing seams are all fin seams. The longitudinal sealing seam extends approximately centrally on the large face, and the two transverse fin seams are folded onto the large face which contains the longitudinal fin seam. There is provided a second, outer wrapper surrounding solely the large faces and the side faces and holding the fin seams folded against the large face.

9 Claims, 2 Drawing Sheets

PACKAGE FOR A FLAT, ANGULAR PRODUCT AND METHOD OF MAKING THE PACKAGE

BACKGROUND OF THE INVENTION

This invention relates to a package for a flat, angular product such as a chocolate bar and includes a wrapper material on which a longitudinal sealing seam is provided that extends on one of the large faces of the product and has further sealing seams at the two opposite short end faces.

In known packages of the above-outlined type, such as disclosed, for example, in Swiss Patent No. 254,978, the wrapper material is an aluminum foil provided on its inner side with a thermoplastic sealing layer. The longitudinal fin seam serves both as a hermetic closure and as a warranty (safety) seal. The two flaps forming the longitudinal fin seam are of equal width and are folded flat onto the top side of the package. The two closures at the opposite short end faces of the item are folded over their two respective flaps onto the underside. This means that the fin seam and the closures interrupt the large package faces which are usually intended to carry promotional messages. Therefore, it is customary to complement the package with a second, paper wrapper. Such a procedure requires a more complex packaging machine, apart from additional packaging material.

German Auslegeschrift (published examined application) No. 1,030,247 discloses an outer paper wrapper for a package of the above-disclosed type wherein on the rear side of the chocolate bar first the short end closures and thereafter the remaining two longitudinal flaps are folded down. Such an overlapping mode of packaging is not adapted for forming sealing seams because such sealing seams must be fin seams. A hermetic seal for the product can therefore not be obtained.

U S. Pat. No. 3,124,298 discloses a package having a longitudinal fin seam which—although not utilized for flat angular items—stands up perpendicularly from a face of the package and thus interrupts the large face of the package making it unadapted for use to display promotional messages thereon.

Swiss Patent No. 655,475 also discloses a wrapper foil provided with an inner sealing coating which, under the formation of a longitudinal fin seam and two end closures is folded about the product. Of the two flaps which form the longitudinal fin seam, the second flap projects, in a mid zone, beyond the edge of the first flap and is, after folding over two longitudinal edges, secured to the underface of the package with adhesive dots. As a result, this type of package has both on its upper face and on its under face a large, uninterrupted surface adapted to carry promotional messages. It is, however, a disadvantage of such a package that for the packaging previously cut individual wrapper sheets are needed so that a high packaging output with the packing machines is not possible.

SUMMARY OF THE INVENTION

It is an object of the invention to provide an improved package which is protected from unauthorized opening or other damaging handling and which may be made in high output, upto-date packing machines.

This object and others to become apparent as the specification progresses, are accomplished by the invention, according to which, briefly stated, all sealing seams of the first wrapper material are fin seams and the longitudinal sealing seam extends at least approximately centrally on one of the large surfaces. Further, the two opposite transverse fin seams forming the end closures are folded down onto the same large surface of the package and there is provided a second wrapper material which is formed as a package sleeve. The package sleeve thus surrounds the product at its two large faces and its two long edge faces and holds in place all the folded-down fin seams.

By folding in the transverse sealing seams there is obtained a desired stiffening of the edge parts thereof, so that pulling them out from under the outer wrapper sleeve is rendered more difficult and, in any event, becomes clearly noticeable.

In case the transverse sealing seams are formed without a pinch fold, the edge portions are slightly enlarged and therefore the wrapper sleeve cannot be pulled off over the edges and cannot be reinserted unnoticed. Consequently the second wrapper (sleeve) need not be glued to the first wrapper material.

Since, however, edges without pinch fold may impede the handling during the making of multi-unit packages or the storage on display racks, it is feasible to provide the transversal sealing seams with pinch folds. As a result, the edges in the wrapper closely engage the product. Therefore, the outer wrapper sleeve has to be secured with at least one glue dot to the first wrapper material for a secure attachment thereto.

DESCRIPTION OF THE PREFERRED EMBODIMENTS

Figure 1:
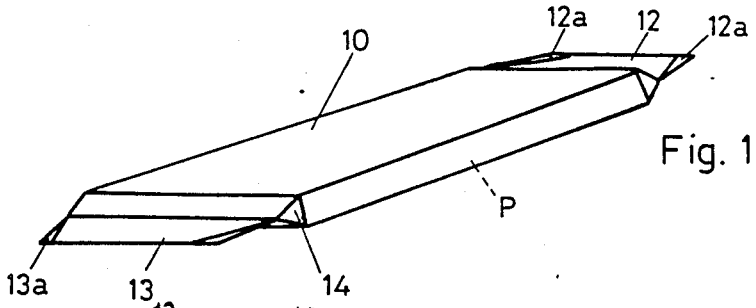
FIGS. 1 and 2 are perspective views of a first embodiment of the invention at an intermediate stage of the packaging process, seen from different positions.
Figure 2:
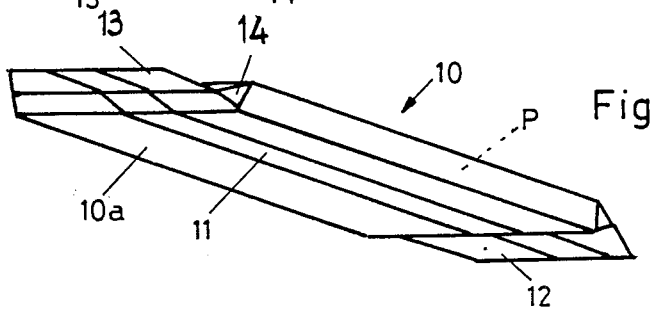

A first embodiment of the invention is illustrated in FIGS. 1–4. A tubular (hose) wrapper 10 enveloping a flat, angular product P, such as a chocolate bar or the like, has a longitudinal seam 11 which extends at least approximately centrally on one of the large faces of the product. The two transverse sealing seams 12 and 13 are sealed in a manner well known in packaging technology and the hose package 10 is severed across the downstream transverse sealing seam 13, as viewed in the direction of article flow in the packing machine.

Figure 3:
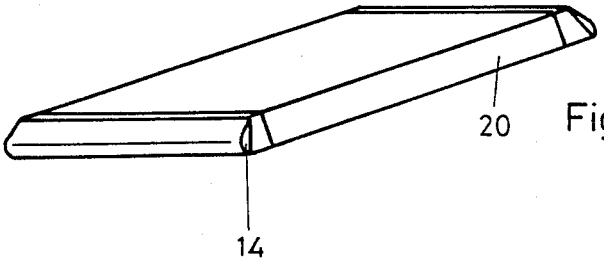
FIGS. 3 and 4 are perspective views of the preferred embodiment, as it appears after a further packaging step and viewed from different positions.
Figure 4:
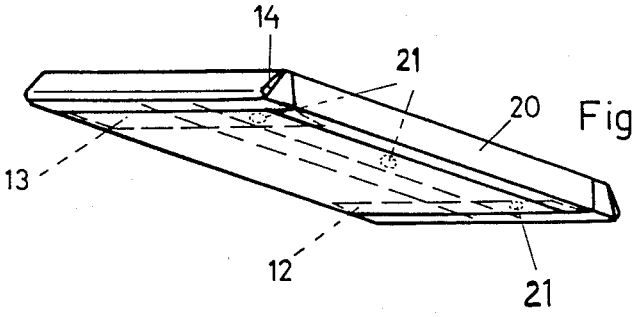
Figure 5:
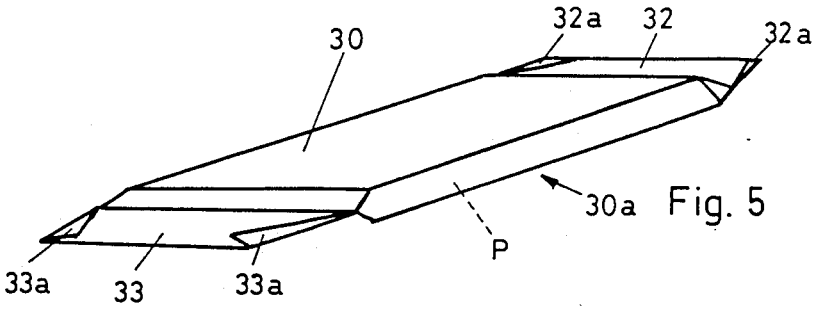
FIGS. 5 and 6 are perspective views of a second embodiment of the invention at an intermediate stage of the packaging process, viewed from different positions.
Figure 6:
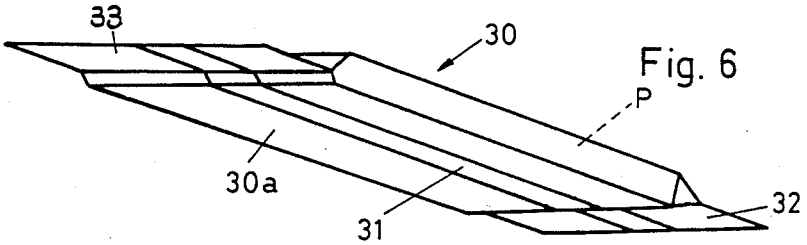

The transverse sealing seams 12 and 13 are provided by producing pinch folds 14 and the tucked-in fold of the packaged product as shown in FIGS. 3 and 4 shows an edge true packaging for the product.

In FIGS. 3 and 4 the hose package 10 is shown surrounded by an outer wrapper band or sleeve 20. By means of gluing, the latter is bonded to the hose package 10 and thus all sealing seams 11, 12 and 13 are covered and even without applying an adhesive, they may not be pulled out of the package and opened without tearing. The gluing may be effected by applying adhesive dots 21 to the wrapper sheet 20.

As also seen in FIGS. 1–4, the edge portions 12*a* and 13*a* are folded over to thus also make a lateral access more difficult.

Figure 7:
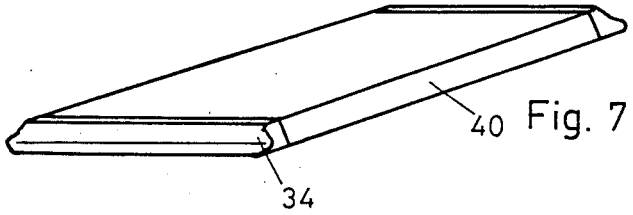
FIGS. 7 and 8 are perspective views of the package shown in FIGS. 5 and 6 subsequent to a further packaging step, seen from different positions.
Figure 8:
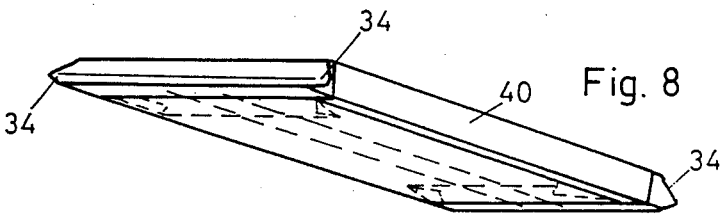

In the second embodiment illustrated in FIGS. 5–8 there is provided a hose package 30 which is similar to that of the hose package 10, except that the transverse seams 32 and 33 are not provided with pinch folds so that subsequent to the downward folding according to FIGS. 7 and 8, the edge portions 34 bulge outwardly underneath the wrapper sleeve 40.

A package of this type too may be manufactured on conventional high-output packing machines. The wrapper sleeve 40 may be wound in an adjoining additional apparatus. The wrapper sleeve 40 is prevented from being pulled off by the outwardly bulging edge portions so that no adhesive bonding has to be provided.

In making the package, a wrapper sheet of indefinite length is advanced and a conventional shaping device forms a hose-like tubular wrapper therefrom. The item is introduced in the tubular wrapper and a longitudinal fin seam is provided to bond lengthwise the tubular wrapper. The fin seam extends on one of the large faces of,. the item. Thereafter, transverse fin seams are formed parallel to and adjacent the respective opposite end faces of the package. Subsequently, the tubular wrapper is severed at the trailing transverse seam as viewed in the direction of advance of the articles. After the severing operation, each transverse fin seam is folded onto itself (whereby a trapezoidal configuration is obtained) and onto that large face where the longitudinal fin seam is located. An outer wrapper sheet is provided with an adhesive area and is wound about the opposite large faces and the opposite side faces of the item such that the outer wrapper is bonded by the adhesive to the hose-like, tubular wrapper.

The present disclosure relates to subject matter contained in Swiss Patent Application No. 1755/87-2 (filed May 8th, 1987) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a package for a flat, generally rectangular item having two opposite large faces, two opposite side faces and two opposite end faces, including a first, inner wrapper folded about the two large faces and the two side faces and having a longitudinal sealing seam extending on one of the large faces generally parallel to the side faces, and opposite transverse sealing seams at respective said end faces extending parallel thereto; the improvement wherein said longitudinal sealing seam and said transverse sealing seams are fin seams; further wherein said longitudinal sealing seam extends approximately centrally on said one large face; further wherein the two transverse fin seams are folded onto said one large face; the improvement further comprising a second, outer wrapper surrounding solely said large faces and said side faces and holding said fin seams folded against said one large face.

2. A package as defined in claim 1, wherein each said transverse fin seam has opposite ends provided with folded-in parts, whereby each said transverse fin seam is of trapezoidal shape.

3. A package as defined in claim 2, wherein said folded-in parts are oriented away from said one large face.

4. A package as defined in claim 1, wherein each said transverse seam has opposite ends provided with pinch folds.

5. A package as defined in claim 4, wherein each said transverse fin seam has opposite ends provided with folded-in parts, whereby each said transverse fin seam is of trapezoidal shape.

6. A package as defined in claim 5, wherein said folded-in parts are oriented away from said one large face.

7. A package as defined in claim 1, further comprising securing means for attaching said second wrapper to said first wrapper.

8. A package as defined in claim 7, wherein said securing means comprises a dot of adhesive.

9. A method of wrapping a flat, generally rectangular item having two opposite large faces, two opposite side faces and two opposite end faces, comprising the following steps:

(a) advancing a first wrapper sheet in a feed direction and forming a hose-like, tubular wrapper therefrom by sealing together opposite longitudinal edge zones thereof by a longitudinal fin seam;

(b) during said forming step, introducing the item into the tubular wrapper such that the longitudinal fin seam extends on one of the large faces parallel to said side faces;

(c) forming transverse fin seams parallel to and adjacent respective said end faces;

(d) severing the tubular wrapper at the trailing transverse seam as viewed in said feed direction;

(e) folding each said transverse fin seam onto (f) providing at least one adhesive dot on a face of a second wrapper sheet; and (g) subsequent to step (e), winding the second wrapper sheet about the large faces and side faces of the article such that the second wrapper sheet is bonded to said tubular wrapper by said adhesive dot.

* * * * *